US009724738B2

(12) United States Patent
Buhl

(10) Patent No.: US 9,724,738 B2
(45) Date of Patent: Aug. 8, 2017

(54) VESSEL SPRAY CLEANING DEVICE

(71) Applicant: SPRAYING SYSTEMS CO., Wheaton, IL (US)

(72) Inventor: Boland Buhl, Walnut Creek, CA (US)

(73) Assignee: Spraying Systems Co., Wheaton, IL (US)

( * ) Notice: Subject to any disclaimer, the term of this patent is extended or adjusted under 35 U.S.C. 154(b) by 305 days.

(21) Appl. No.: 14/604,852

(22) Filed: Jan. 26, 2015

(65) Prior Publication Data

US 2015/0209842 A1 Jul. 30, 2015

Related U.S. Application Data

(60) Provisional application No. 61/931,751, filed on Jan. 27, 2014.

(51) Int. Cl.

| | |
|---|---|
| ***B08B 9/093*** | (2006.01) |
| ***B08B 9/08*** | (2006.01) |
| *B05B 3/02* | (2006.01) |
| *B05B 13/06* | (2006.01) |

(52) U.S. Cl.

CPC ..... *B08B 9/0813* (2013.01); *B05B 3/027* (2013.01); *B05B 3/028* (2013.01); *B05B 13/0636* (2013.01); *B08B 9/0826* (2013.01)

(58) Field of Classification Search

CPC .. B60S 3/04; B60S 3/047; B60S 3/044; B60S 3/042; B08B 9/0808; B08B 9/0813

USPC ..... 134/166 R, 167 R, 168 R

See application file for complete search history.

(56) References Cited

U.S. PATENT DOCUMENTS

| | | | | |
|---|---|---|---|---|
| 1,724,702 A * | 8/1929 | Flickinger | A01G 25/09 239/723 |
| 2,712,960 A * | 7/1955 | Grubb, Jr. | A01G 25/09 239/261 |
| 2,933,093 A * | 4/1960 | Handyside | B05B 3/066 134/168 R |
| 5,908,163 A * | 6/1999 | Wells | B05B 1/3006 239/588 |
| 6,557,566 B1 * | 5/2003 | Rudolfs | B08B 9/0813 134/148 |
| D592,364 S * | 5/2009 | Diciuccio | D32/4 |

(Continued)

FOREIGN PATENT DOCUMENTS

AU WO 2016029258 A1 * 3/2016 ..... B05B 1/044

*Primary Examiner* — Michael Wieczorek
*Assistant Examiner* — Kevin G Lee
(74) *Attorney, Agent, or Firm* — Leydig, Voit & Mayer, Ltd.

(57) ABSTRACT

A spray cleaning device for cleaning the interior of a vessel or the like through an access opening in an underside thereof. The cleaning device includes a wheeled carriage positionable in selected relation to a vessel to be cleaned, an elongated frame having a central drive shaft extending along its length, and a rotatable spray head supported in an upstanding relation to a downstream end of said elongated housing for rotation about multiple axes. The elongated frame is pivotably supported by said wheeled carriage for selective positioning of the spray head within the vessel to be cleaned, and the spray head has a liquid supply which communicates with a liquid inlet to an upstanding support thereof downstream of the central drive shaft so said liquid is not transmitted along the drive shaft.

15 Claims, 11 Drawing Sheets

(56) References Cited

U.S. PATENT DOCUMENTS

| | | | | |
|---|---|---|---|---|
| 8,024,995 | B2 * | 9/2011 | Dayton | B25F 3/00 173/216 |
| 2008/0127875 | A1 * | 6/2008 | Hoogeveen | B08B 9/023 114/312 |
| 2008/0142042 | A1 * | 6/2008 | Bramsen | B08B 9/0936 134/18 |
| 2010/0186784 | A1 * | 7/2010 | Ross | B05B 3/028 134/167 R |

* cited by examiner

VESSEL SPRAY CLEANING DEVICE

CROSS-REFERENCE TO RELATED APPLICATION

This patent application claims the benefit of the U.S. Provisional Patent Application No. 61/931,751, filed. Jan. 27, 2014, which is incorporated by reference.

FIELD OF THE INVENTION

The present invention relates generally to spray cleaning devises for cleaning liquid storage and processing vessels, barrels, tanks, and like containers, that are supported by cradles or other support apparatus with a closable access opening or drain hole in an underside thereof for enabling entry of a spray head of a cleaning device into the interior of the vessel and drainage of the cleaning liquids from the vessel.

BACKGROUND OF THE INVENTION

It is known to support processing vessels in elevated relation to the floor to facilitate cleaning of the interior of the vessel from an opening in a bottom side. In wine production, for example, wine is processed in large generally cylindrical barrels that are supported during processing on cradle like racks in elevated relation to the floor. Upon completion of processing and removal of the wine from the container, it is necessary that the interior of the barrel be thoroughly cleaned. For this purpose, it is known to rotate the barrel on its support such that the access opening in a side of the barrel is facing downwardly. In such position, cleaning fluids may be directed into the interior of the container from the access opening and simultaneously drained from the barrel.

For this purpose, it is known to insert a rotary spray head of a cleaning device through the access opening and to operate the spray head such that is rotates about multiple axes for complete coverage and thorough cleaning of the interior of the barrel. Since the spray head must be inserted from an underside of barrel, it can be cumbersome to position the spray head into the barrel and to effectively drive the spray head, particularly when space below the barrel is limited. To enable reliably controlled rotation of the spray head, it is known to use a mechanical drive. Again, due to the limited space, it can be difficult to mechanically drive the upwardly oriented spray head while directing pressurized liquid to the spray head. To the extent the mechanical drive is housed within the liquid supply line, it further is necessary to securely seal the containment of the drive along its length for preventing liquid leakage. Moreover, when the drive is driven by an electrical motor, safety hazards can exist due to the wet environment about the barrels during cleaning.

SUMMARY AND OBJECTS OF THE INVENTION

It is an object of the present invention to provide a more efficient and easy to use spray cleaning device for cleaning storage vessels, such as wine barrels, from an underside access opening.

Another object is to provide a vessel spray cleaning device as characterized above that is more easily adaptable for use with vessels supported at different elevations with respect to the floor.

A further object is to provide a vessel cleaning device of the foregoing type having a mechanically driven rotary spray head adapted for more reliable operation.

Still a further object is to provide a vessel cleaning device of the above kind in which the cleaning liquid supply is substantially separated from the spray head drive in a manner that reduces sealing requirements for the drive.

Another object is to provide a vessel cleaning spray device as described above which is relatively simple and economical in construction and lends itself to easy and more reliable usage.

Other objects and advantages of the invention will become apparent upon reading the following detailed description and upon reference to the drawings, in which:

Figure 1:
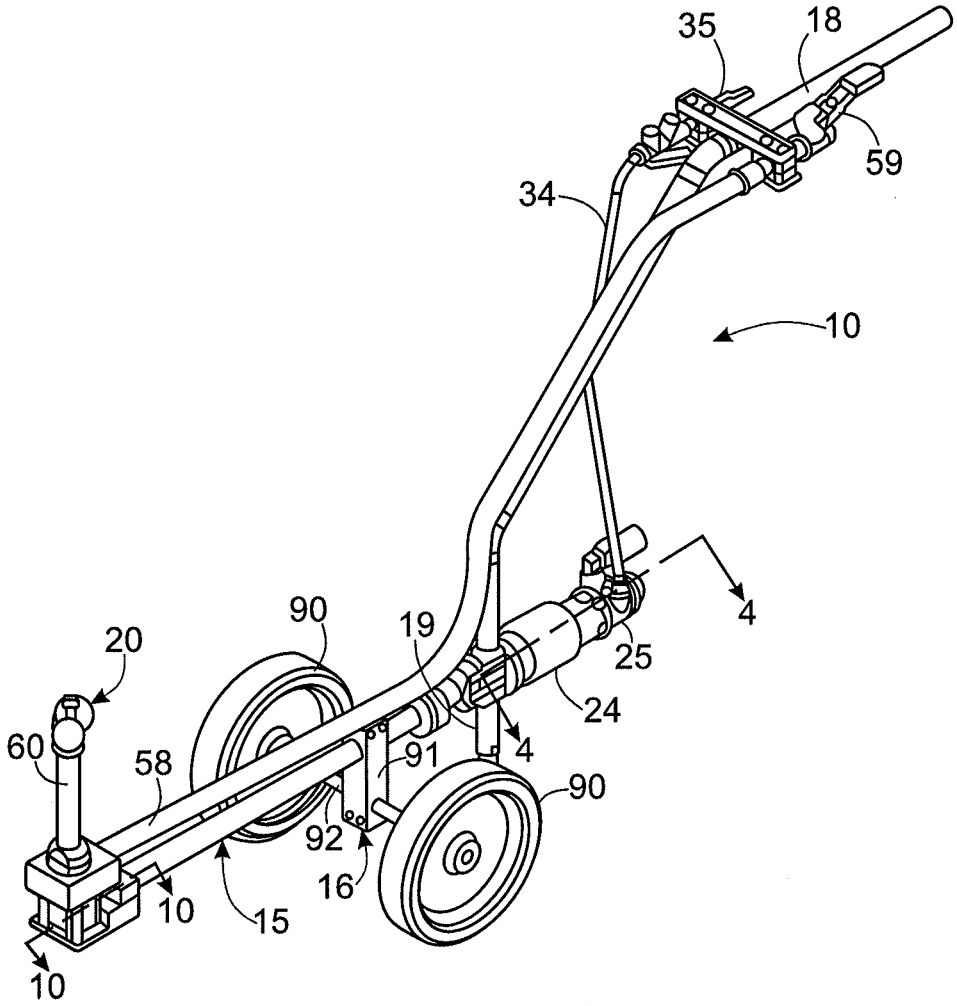
FIG. 1 is a prospective of an illustrative vessel spray cleaning device in accordance with the invention.

While the invention is susceptible of various modifications and alternative constructions, a certain illustrative embodiment thereof has been shown in the drawings and will be described below in detail. It should be understood, however, that there is no intention to limit the invention to the specific form disclosed, but on the contrary, the invention is to cover all modifications, alternative constructions, and equivalents falling within the spirit and scope of the invention.

DETAILED DESCRIPTION OF THE PREFERRED EMBODIMENT

Figure 3:
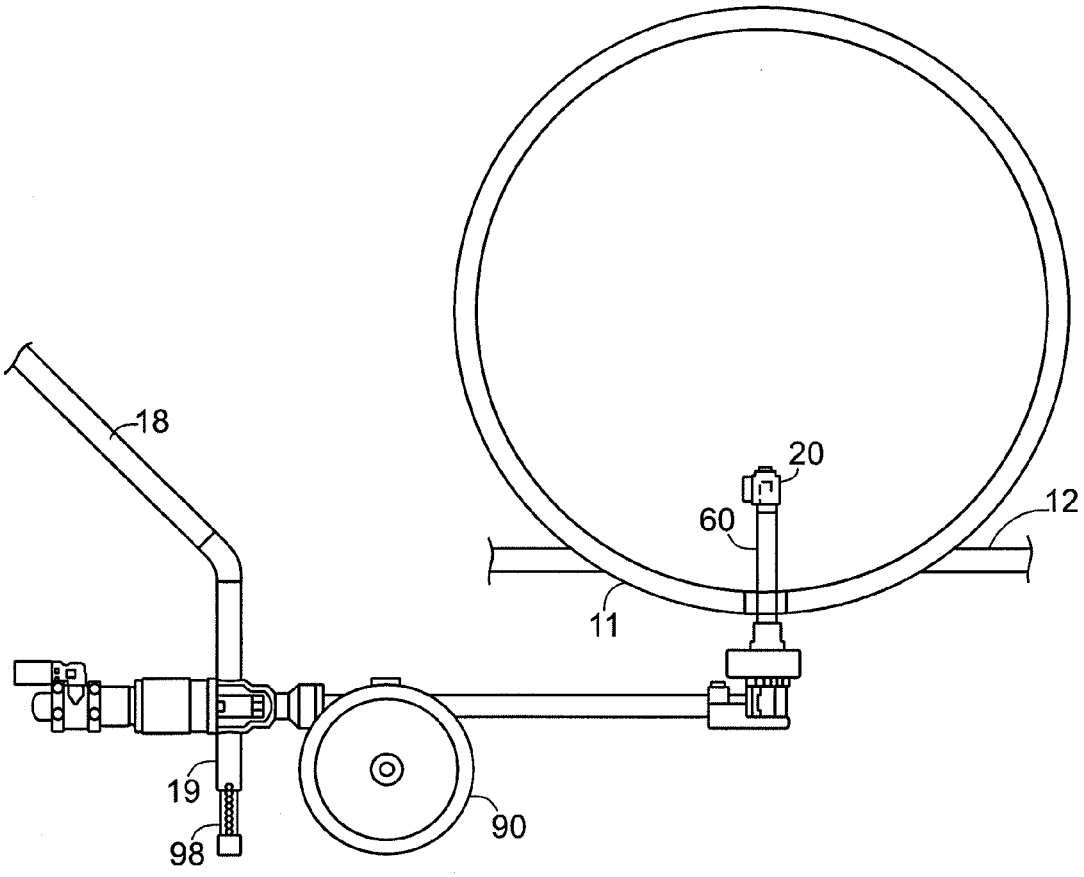
FIG. 3 is a side elevational view, similar to FIG. 2, showing the spray device with the spray head in a raised position within the vessel for a cleaning operation.

Referring now more particularly to the drawings, there is shown an illustrative vessel spray cleaning device 10 in accordance with the invention, which in this case is depicted for use in cleaning of a wine barrel 11 supported on a rack 12 in elevated relation to a floor as depicted in FIG. 3. The wine barrel 11 is of a conventional type, having closed ends and a generally cylindrical outwardly bowed sidewall with an access opening 14 centrally located in the sidewall that is plugged during processing of wine. Following completion of processing and removal of the contents from the barrel, the barrel 11 must be thoroughly cleaned, and for this purpose, it is rotated on its rack 12 with the axis opening 14 in the underside of the barrel 11.

The illustrated cleaning device 10 basically comprises an elongated frame in the form of a straight cylindrical extension tube 15, preferably made of stainless steel, supported by a wheeled carriage 16 and having an elongated elevated handle 18 and a depending stabilizing leg 19 at one end and an upstanding rotatable spray head 20 at an opposite end for positioning into a vessel from an underside access opening for spray cleaning of the interior during a cleaning operation.

Figure 4:
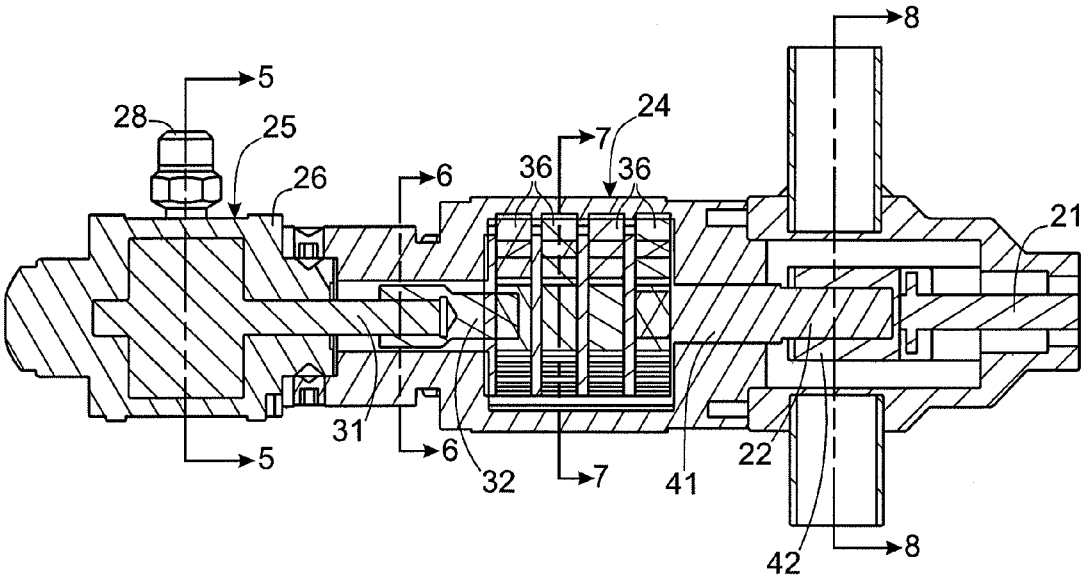
FIG. 4 is an enlarged fragmentary longitudinal section of the drive for rotating a main drive shaft of the spray cleaning apparatus, taken in the plain of FIG. 4-4 in FIG. 1.
Figure 5:
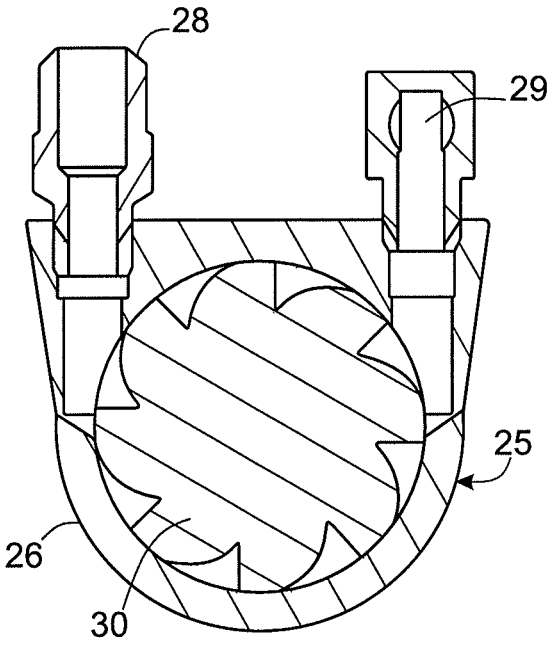
FIG. 5 is an enlarged fragmentary section taken in the plain of line 5-5 in FIG. 4.
Figure 6:
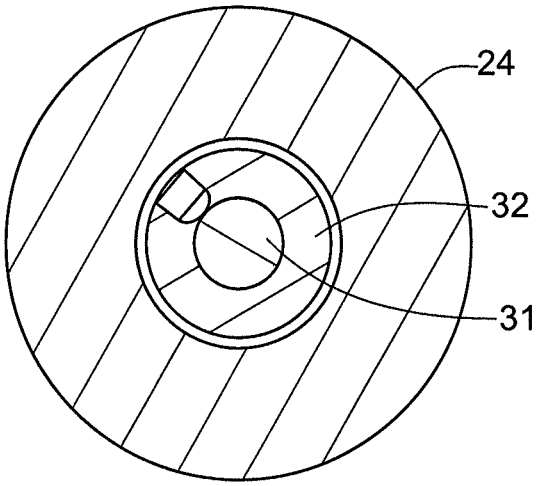
FIG. 6 is an enlarged fragmentary section taken in the plain of line 6-6 in FIG. 4.

In accordance with a feature of the illustrated embodiment, the spray cleaning device 10 has a mechanical drive for more efficiently and effectively rotating the spray head 20 during a cleaning operation. To this end, in the illustrated embodiment, the extension tube 15 houses an elongated rigid central drive shaft 21 (FIGS. 4 and 10) that extends along a length of the extension tube 15. The drive shaft 21 in this instance has an upstream end coupled to an output shaft 22 of a planetary gearbox 24, which in turn is operated by an air driven motor 25 (FIG. 4). The air motor 25 has a housing 26 fixedly mounted on an upstream end of the planetary gearbox 24 having a pressurized air inlet 28 and a muffled exhaust outlet 29, as depicted in FIG. 5. Pressurized air directed to the inlet 28 is effective for rotating a veined rotor 30 of the air motor 25 having an output shaft 31 coupled to an input shaft 32 of the planetary gearbox 24, such as by a set screw or the like. The air inlet 28 in this instance is supplied pressurized air from a supply line 34 (FIG. 1) extending along the handle 18 having an upstream end for coupling to a suitable pressurized air source, and a manually operable lever 35 is mounted on the handle 18 for enabling an operator to control the direction of pressurized air to the air motor 25 for controlling rotation of the air motor 25 and central drive shaft 21. Since the air motor 25 is driven by a remote pressurized air source, it will be appreciated that the spray cleaning device 10 may be operated free of any electrical motor or the like in the vicinity of the spray cleaning device that could create an electrical safety hazard.

Figure 7:
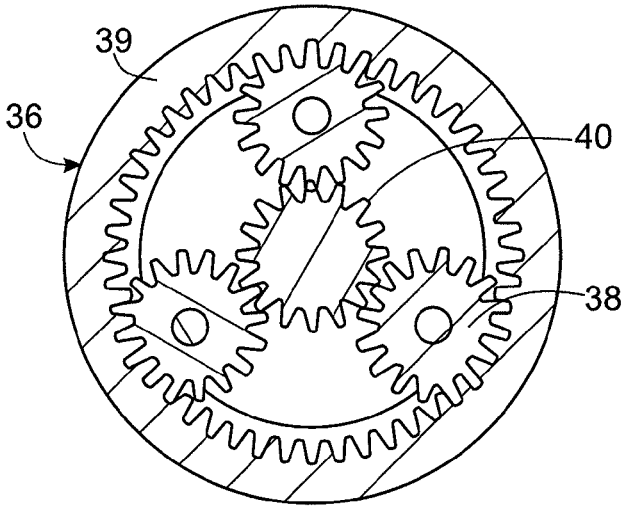
FIG. 7 is an enlarged fragmentary section taken in the plain of line 7-7 in FIG. 4.
Figure 8:
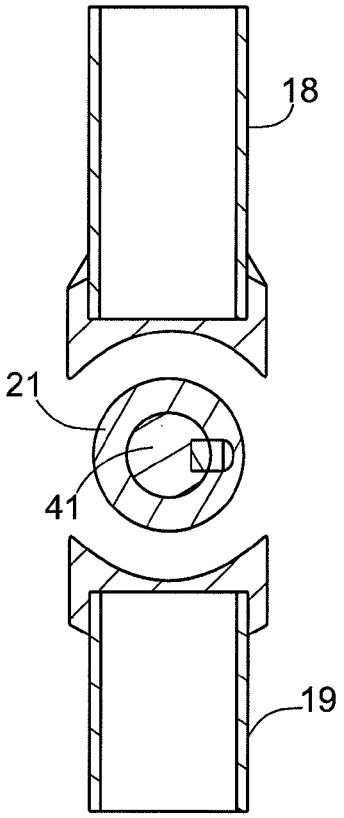
FIG. 8 is an enlarged fragmentary section taken in the plain of line 8-8 in FIG. 4.

The planetary gearbox 24 comprises a housing that contains a plurality of planetary gear stages 36 (FIG. 4) each having planet gears 38 mounted within a ring gear 39 on a conventional carrier and operable about a central sun gear 40 (FIG. 7). The ratio between gears at each stage 36 reduces the rotational speed of the carrier relative to the input shaft 32 and the multiple stages compound the overall speed reduction such that rotation of an output shaft 41 of the gearbox 24 may be significantly reduced, such as by a ratio of up to 600:1, resulting in the gearbox output shaft having a substantially reduced final rotational speed, such as about 10 r.p.m. The gearbox output shaft 41 in this case is fixedly connected to the central drive shaft 21 by a coupling 42 so that the drive shaft 21 is driven at its reduced speed.

Figure 10:
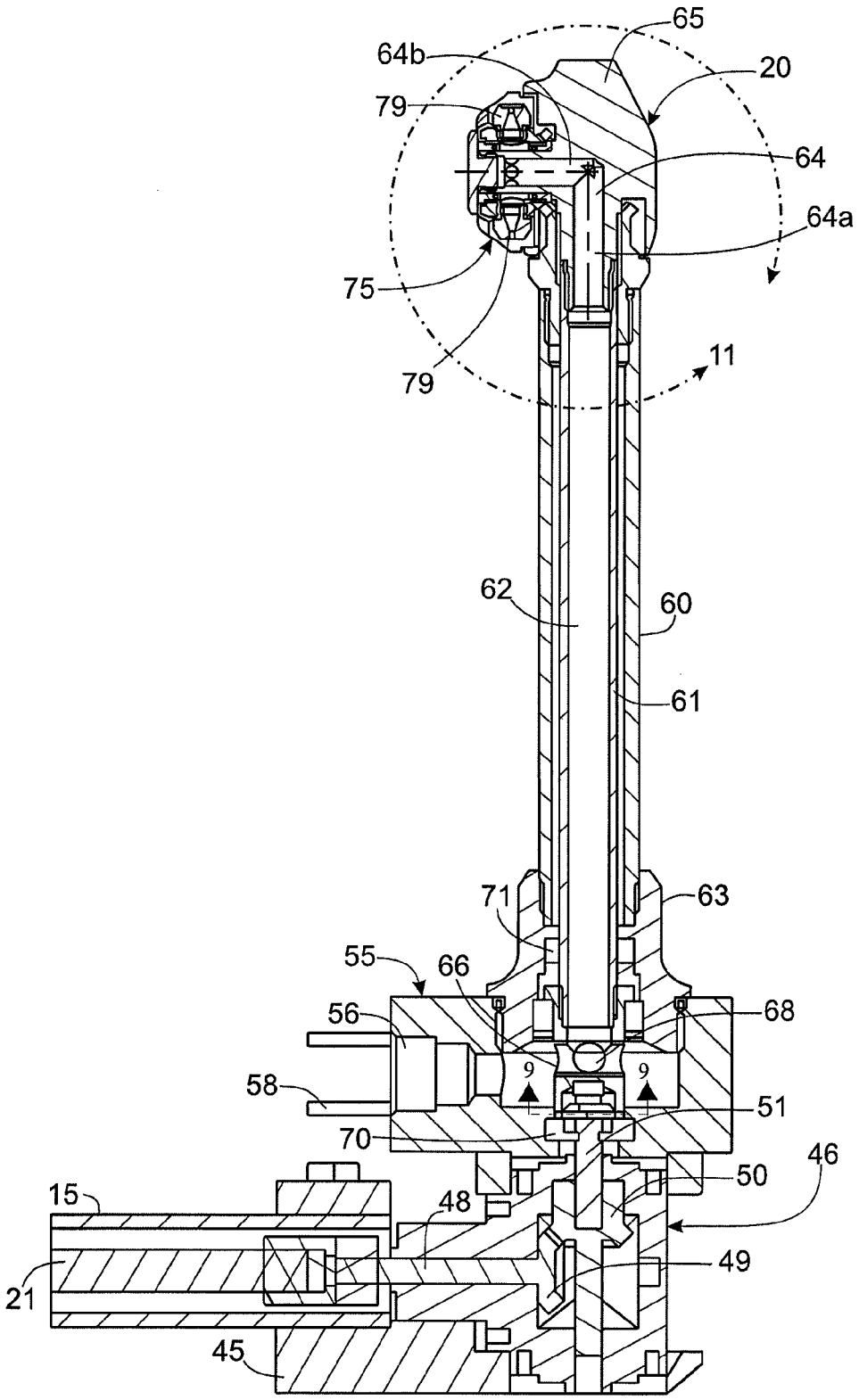
FIG. 10 is an enlarged fragmentary section of the rotary spray head and drive of the spray cleaning device, taken in the plain of line 10-10 in FIG. 1.

In keeping with this embodiment, the rotary spray head 20 is supported in upstanding relation to a downstream end of the extension tube 15 by a supporting block or bracket 45 fixedly mounted on the end of the extension tube 15, which in turn carries a right angle gearbox 46 (FIG. 10). The drive shaft 21 is coupled to an input shaft 48 of a bevel gear 49 of the right angle gearbox 46, which in turn drives a passive bevel gear 50 having an upstanding output shaft 51. It will be understood that while the illustrated right angle gearbox 45 utilizes a bevel gear drive, alternatively a worm gear right angle drive could be used.

In further carrying out the present embodiment, pressurized liquid is directed to the spray head 20 at a location downstream of the right angle gearbox 46 so as to eliminate the necessity for transmitting liquid through the extension tube 15 about the drive shaft 21 and required sealing of the extension tube 15. In this case, a liquid inlet fitting 55 is mounted on an upper end of the right angle gearbox 46 having a liquid inlet 56 communicating through a side thereof to which a liquid supply line 58 is connected, which in this case is trained along the extension tube 15 and handle 18 and controlled by an on/off trigger 59 adjacent the air control valve 35 at the upper end of the handle 18. It will be understood that a pressurized liquid supply line, such as from a pressure washer or other pressurized liquid source, may be connected to the liquid supply line 58 at the upper end of the handle 18.

Figure 9:
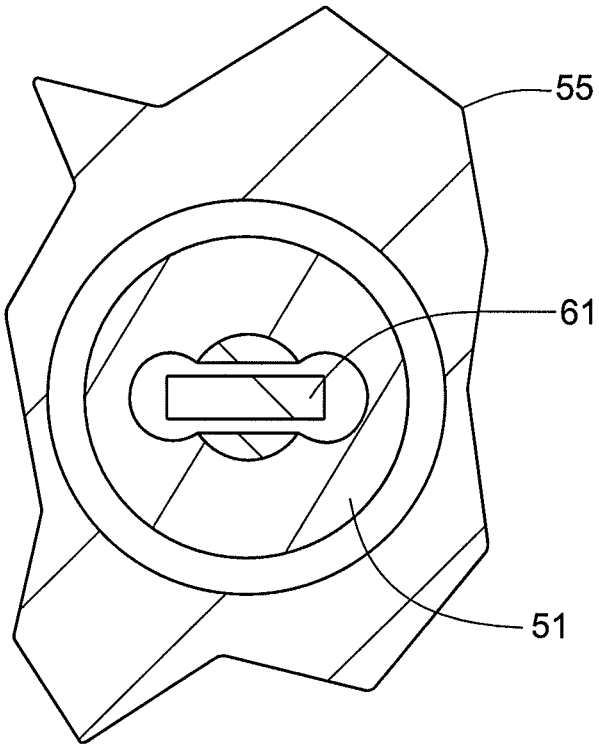
FIG. 9 is an enlarged fragmentary section taken in the plain of 9-9 in FIG. 10.
Figure 11:
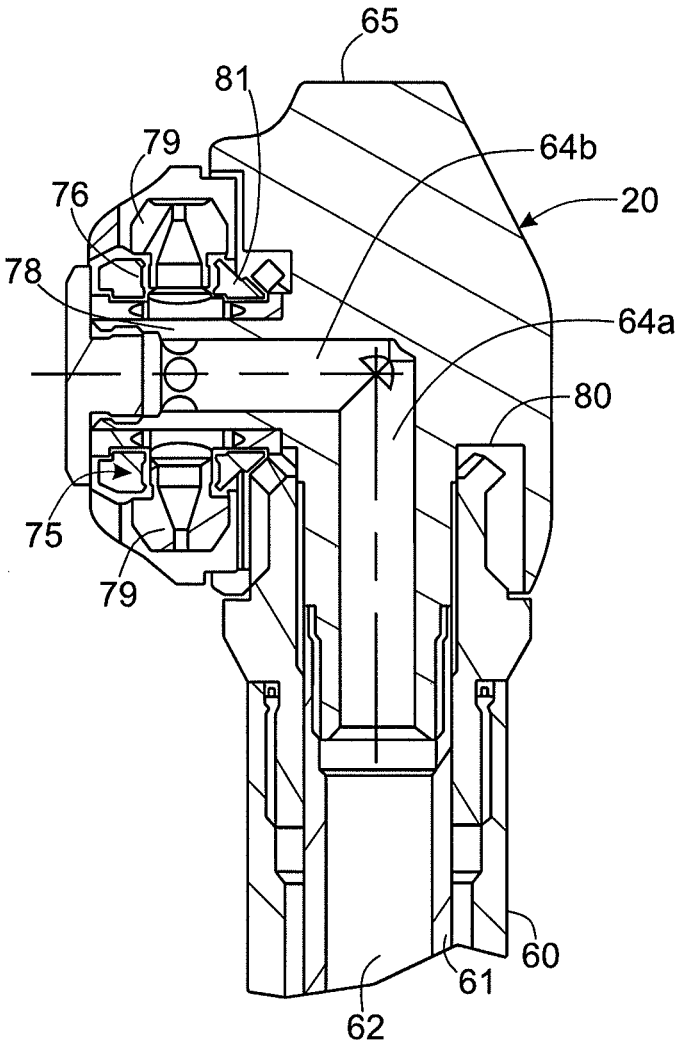
FIG. 11 is an enlarged fragmentary section of the spray head, taken in the circular area in FIG. 10 designated 11.

The rotary spray head 20 in this case is supported at the upper end of a fixed tubular housing member 60 mounted within a fitting part 63 secured, such as by means of an upstream threaded end to the top of the liquid inlet fitting 55. For simultaneously rotating and supplying liquid to the spray head 20, a drive and liquid flow tube 61 is mounted for relative rotation within the fixed tubular housing 60 (FIGS. 10 and 11). A lower end of the drive and flow tube 61 is coupled to the output shaft 51 of the right angle gearbox 40 by a pin and groove connection, as depicted in FIG. 9, such that rotation of the drive shaft 21 causes direct rotation of the drive and flow tube 61. The drive and flow tube 61 defines a liquid flow passage 62 communicating between the liquid inlet 56 and a right angle liquid flow passage 64 in a housing 65 of the rotary spray head 20 having an upstream vertical axis portion 64*a* and a downstream horizontal axis portion 64*b*. For enabling fluid communication between the liquid inlet 56 and the drive and flow tube liquid passage 62, the liquid inlet fitting 55 defines an annular manifold passage 66 about a lower end of the drive and flow tube 61 for communicating liquid from the liquid inlet 65 into the upstanding flow passage 62 through a plurality of radial passages 68 in the drive and flow tube 61 notwithstanding relative rotary movement of the drive and flow tube 61. Seals 70 and 71 are provided on opposite upper and lower sides of the annular manifold passage 66. It will be seen therefore that rotation of the drive shaft 21 in turn drives the bevel gears 48, 49 and rotates the drive and flow tube 61 and the rotary spray head 20 fixed to the upper end thereof about a vertical axis.

The rotary spray head 20 includes a rotary nozzle assembly 75 supported on the spray head housing 65 for rotation about the horizontal axis passage section 64*b*. The rotary nozzle assembly 75 includes an annular body 76 rotatably supported on a horizontal hub 78 of the spray head housing 65, which carries a pair of spray nozzles 79 disposed in 180 degree opposed relation to each other each communicating with the horizontal passage section 64*b*.

For rotating the rotary spray nozzle assembly 75 about the axis horizontal of the passage portion 64*b* simultaneous with rotation of the rotary head 20 about the vertical axis, a bevel gear 80 is mounted in fixed relation to an upper end of the fixed tube 60, which cooperates with passive bevel gear 81 of the rotary nozzle assembly 75 such that rotation of the spray head 20 relative to the fixed tube 60 and fixed bevel gear 80 simultaneously rotates the rotary nozzle assembly 75 about the hub 78 of the spray head. It will be appreciated by one skilled in the art that the mechanical drive for the rotary spray head 20 enables reliable operation of the spray device 10 as an incident to rotation of the drive shaft 21 without inconsistencies that occur from pressure variations and the like in fluid operated rotary spray devices.

Figure 2:
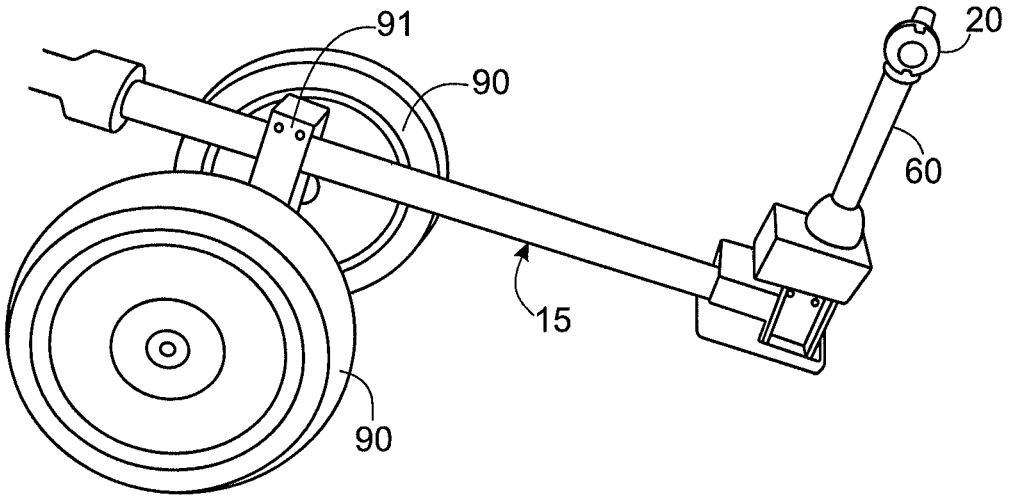
FIG. 2 is a side elevational view showing the spray cleaning device of FIG. 1 in a lowered position below a vessel to be cleaned.

In carrying out a further feature of the illustrated embodiment, the spray device 10 is adapted for more versatile and efficient usage in cleaning barrels, containers, and storage vessels, of different sizes and which are supported with different clearance spaces between the floor and the underside of the vessel. To this end, the carriage 16 cleaning device 10 has relatively large diameter wheels 90, such as at least about 8 inches in diameter, and the extension tube 15 is supported by the carriage 16 in elevated relation to the axis of the wheels 90, preferably at a level adjacent an upper side of the wheels. Such arrangement enables greater versatility in the range of movement of the spray head 20 between a lower position (FIG. 2) for locating under the vessel and a raised position with the spray head 20 optimally positioned within the vessel, as depicted in FIG. 3.

Figure 12:
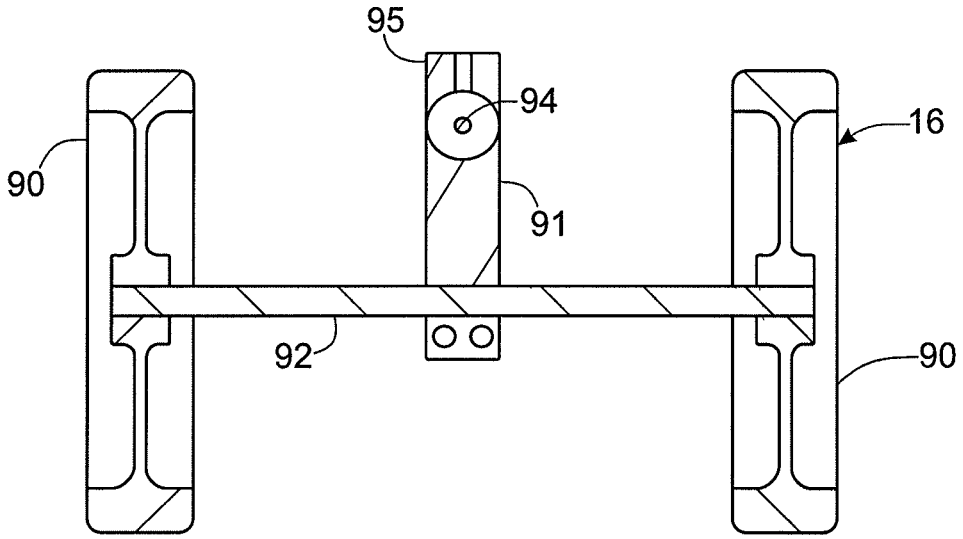
FIG. 12 is an enlarged fragmentary section taken in the plan of line 12-12 in FIG. 13; and, FIG. 13 is an enlarged fragmentary side elevational view of the illustrative spray device showing the extendable stabilizing leg of the spray device.

To further enhance versatile use of the spray device the wheeled carriage 16 is adopted for adjustably positioning along the length of the extension tube 16 intermediate its ends. To permit such adjustability in positioning of the carriage 16, the carriage 16 has an upstanding support 91 mounted centrally on an axel 92 of the carriage 16, which has a horizontal opening 94 (FIG. 12) within which the extension tube 12 is disposed and a pair of upwardly extending flanges 95 that can be selectively clamped by a cross screw or like fastener for securement of the carriage 16 in a desired location, Hence, the extension tube 16 may be suitably positioned and supported by the carriage at any location along its axial length best suited for the particular spray application. It will be appreciated by one skilled in the art that the reasonably relatively large carriage wheels 90, preferably having a diameter at least half the clearance space between the floor and the underside of vessel to be cleaned, together with the raised support of the extension tube 16 that forms the central frame of the spray cleaning device, enables enhanced versatility in positioning the spray head into vessels supported at different elevations with respect to the floor.

Figure 13:
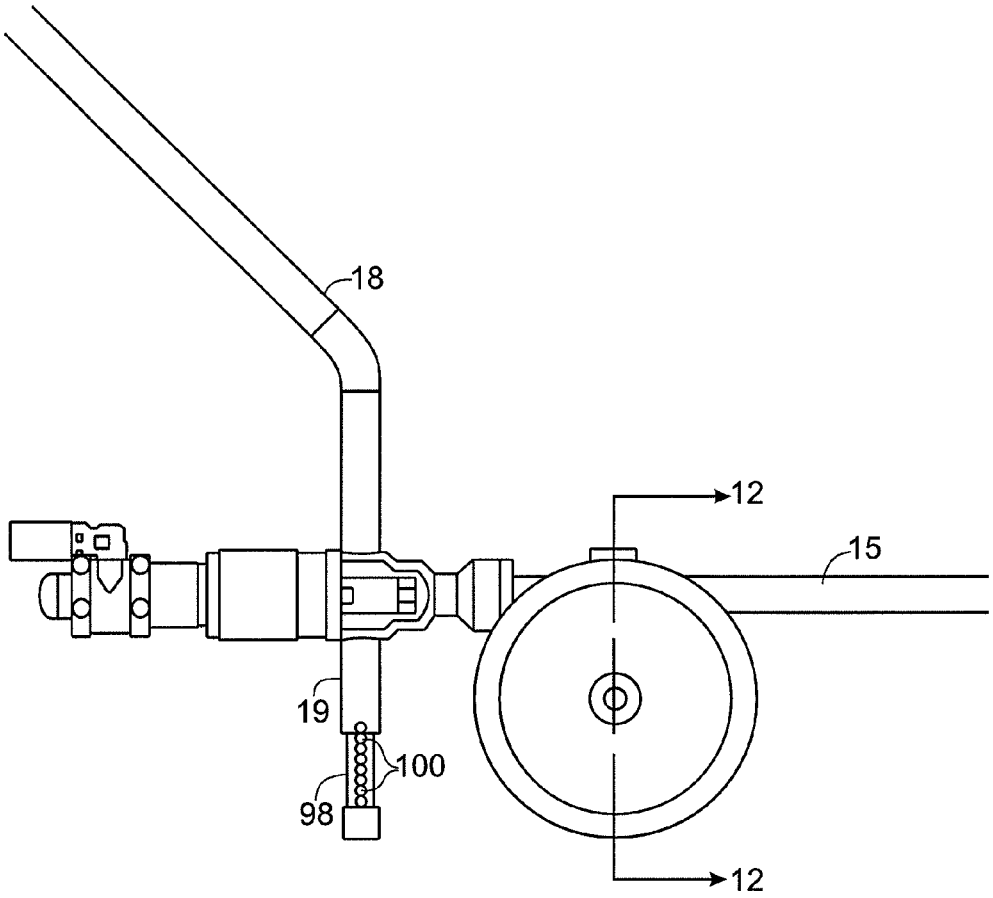

For stabilizing the position of the spray head in optimal position within a vessel to be cleaned during a spraying operation, the depending leg 19 has an adjustable lower foot at extension 98 that can be raised and lowered relative to the leg 19 (FIG. 13). For maintaining the foot at the desired position, the leg 19 and foot 98 have vertically spaced apertures 100 which can be aligned and secured in a selected position by a cotter pin or the like.

From the foregoing, it can be seen that a vessel spray cleaning device is provided that is adapted for more reliable and versatile usage. It utilizes a mechanical drive that is reliable in operation, relatively simple and economical in construction, and is substantially separated from the cleaning liquid supply to the spray device so as to reduce seating requirements. Its adjustability features enables it to be versatilely used in different spray applications.

The invention claimed is:

1. A spray cleaning device for cleaning a vessel through an access opening in an underside thereof comprising:

a carriage positionable in selected relation to a vessel to be cleaned;

an elongated frame supported by said carriage;

a rotatable spray head supported in elevated relation to said elongated frame by an upstanding support at a downstream end of said elongated frame;

said rotatable spray head having a liquid inlet for communication with a liquid supply;

a central drive shaft extending along said elongated frame;

a drive at an upstream end of said elongated frame for rotating said central drive shaft;

a control for controlling operation of said drive;

an angular gear mechanism at a downstream end of said elongated frame operable for rotating said spray head about a central axis of the upstanding support in response to rotatable driving movement of said central drive shaft;

a bevel gear mechanism between said rotatable spray head and said upstanding support for rotating said spray head about a transverse axis transverse to the central axis of said upstanding support as an incident to rotatable driving movement of said drive shaft and operation of said angular gearing mechanism;

said rotatable spray head having at least one spray nozzle communicating with said spray head inlet for discharging a liquid spray in a direction transverse to the transverse axis of said spray head; and said elongated frame being pivotably supported by said carriage intermediate ends of the elongated frame for facilitating selective vertical positioning of said spray head into the underside opening of the vessel to be cleaned.

2. The spray cleaning device of claim 1 in which said carriage has wheels to facilitate selected movement of the carriage for positioning of said spray head relative to the access opening of the vessel to be cleaned.

3. The spray cleaning device of claim 2 in which said central drive shaft is disposed within said elongated frame, and said elongated frame is supported by said carriage in elevated relation to an axis of said wheels.

4. The spray cleaning device of claim 3 in which said upstanding support includes an internal tubular member which defines a liquid flow passage through the upstanding support to said rotatable spray head and which is rotatably driven by said central drive shaft and bevel gear mechanism for rotating said spray head about the central axis of the upstanding support.

5. The spray cleaning device of claim 2 in which said elongated frame is supported by said carriage in elevated relation to an axis of said wheels.

6. The spray cleaning device of claim 5 in which said elongated frame is supported by said carriage at a level adjacent an upper side of said wheels.

7. The spray cleaning device of claim 6 in which said wheels have a diameter of at least 8 inches.

8. The spray cleaning device of claim 5 including an adjustable stabilizing leg disposed in depending relation to an upstream end of said elongated frame for maintaining the spray head in predetermined position within a vessel to be cleaned.

9. The spray cleaning device of claim 1 in which said central drive shaft is disposed within said elongated frame.

10. The spray cleaning device of claim 9 in which said upstanding support includes a liquid supply passage communicating with the liquid inlet of said spray head, and said upstanding support liquid supply passage having a liquid inlet downstream of said elongated frame and central drive shaft wherein liquid is communicated to the liquid supply passage of said upstanding support without transmission about said central drive shaft.

11. The spray cleaning device of claim 10 in which said liquid supply passage of said upstanding support is defined by an internal tubular member, said internal tubular member having a liquid inlet in fluid communication with the liquid inlet of said upstanding support liquid supply passage, and said tubular member being rotatably driven by said angular gear mechanism in response to driving movement of said central drive shaft for rotating said spray head about the central axis of said upstanding support.

12. The spray cleaning device of claim 11 including a liquid inlet fitting mounting downstream of said angular gear mechanism defining said liquid inlet of said upstanding support liquid supply passage.

13. The spray cleaning device of claim 1 in which said central drive shaft has an upstream end coupled to an output shaft of a planetary gear mechanism which in turn has an input shaft coupled to said drive, and said planetary gear mechanism being operable for reducing the rotational speed of the output shaft and central drive shaft in relation to the speed of said input shaft.

14. The spray cleaning device of claim 1 in which said elongated frame is mounted on said carriage for adjustable positioning along the length of the elongated frame.

15. The spray cleaning device of claim 1 in which said rotatable spray head includes a plurality of discharge orifices for discharging liquid in directions transverse to the transverse axis of said spray head.

* * * * *